US007080836B2

(12) United States Patent
Hamada et al.

(10) Patent No.: US 7,080,836 B2
(45) Date of Patent: Jul. 25, 2006

(54) SHEET FEEDING APPARATUS AND IMAGE READING APPARATUS EQUIPPED WITH THE SAME

(75) Inventors: Masataka Hamada, Yamanashi-ken (JP); Tetsuya Noda, Minami-Alps (JP); Osamu Jinza, Yamanashi-ken (JP)

(73) Assignee: Nisca Corporation, Yamanashi-ken (JP)

( * ) Notice: Subject to any disclaimer, the term of this patent is extended or adjusted under 35 U.S.C. 154(b) by 0 days.

(21) Appl. No.: 10/861,492

(22) Filed: Jun. 7, 2004

(65) Prior Publication Data

US 2004/0262837 A1 Dec. 30, 2004

(30) Foreign Application Priority Data

Jun. 12, 2003 (JP) ..... 2003-167739

(51) Int. Cl.
*B65H 5/06* (2006.01)

(52) U.S. Cl. ..... 271/274; 271/272; 271/273

(58) Field of Classification Search ..... 271/274, 271/273, 272

See application file for complete search history.

(56) References Cited

U.S. PATENT DOCUMENTS 5,918,876 A * 7/1999 Maruyama et al. ..... 271/228

FOREIGN PATENT DOCUMENTS

| | | |
|---|---|---|
| JP | 04072246 A * | 3/1992 |
| JP | 8-1232 | 1/1996 |
| JP | 08-225221 | 9/1996 |

* cited by examiner

*Primary Examiner*—Eileen D. Lillis
*Assistant Examiner*—Kaitlin Joerger
(74) *Attorney, Agent, or Firm*—Manabu Kanesaka

(57) ABSTRACT

A sheet transport apparatus includes a transport path for transporting a sheet, and drive and follower roller units disposed in the transport path. The drive roller unit has a drive shaft and at least two drive rollers arranged on the drive shaft in a direction perpendicular to a sheet transport direction. The follower roller unit has a follower shaft and at least two follower rollers contacting the at least two drive rollers. An urging device is attached to the follower shaft for pressing the at least two follower rollers to the at least two drive rollers in a direction with a predetermined angle with respect to the drive shaft.

12 Claims, 10 Drawing Sheets

SHEET FEEDING APPARATUS AND IMAGE READING APPARATUS EQUIPPED WITH THE SAME

BACKGROUND OF THE INVENTION AND RELATED ART STATEMENT

The present invention relates to a sheet feeding apparatus for transporting sheets such as a plastic film and, more particularly, relates to a transport roller configuration for transporting sheets in a predetermined direction without damaging the sheets and an image reading apparatus such as a scanner apparatus or copier apparatus equipped with the sheet feeding apparatus.

Generally, a sheet transport apparatus and an image reading apparatuses equipped with a sheet transport apparatus consecutively transport sheets, and include various devices, i.e. a sheet supply unit, sheet processing unit and sheet discharge unit such as a copier, a printing machine or a paper currency handling apparatus, as disclosed, for example, in Japanese Patent Publication (Kokai) No. 08-225221. A variety of methods such as a vacuum transport method, an endless belt method, and a roller method have been used for transporting sheets. As a simple transport mechanism, a pair of rollers may be used for nipping and transporting sheets.

The present invention relates to a structure having a pair of rollers for nipping and transporting sheets. Conventionally, as a method of transporting sheets using a drive roller and a follower roller contacting each other, there have been a structure using one roller positioned at the center of the sheets, and another structure having more than two rollers arranged in a width direction of the sheets. When a plurality of sheets having different widths is transported, the latter method has been primarily used.

In the structure having a plurality of rollers to transport the sheets, there are problems of causing the sheets to be wrinkled or dirty. In order to transport the sheets with high precision without slipping, it is necessary to firmly nip the sheets with a pair of drive and follower rollers. When the sheets are firmly nipped for transport, it is well known that two (or more) rollers arranged in the sheet width direction may apply unequal pressure to the sheets, thereby causing wrinkle or stain in the sheets or generating unusual sounds in-the system.

Japanese Patent Publication (Kokai) No. 08-225221 has disclosed a method in which rollers transport sheets in different width directions to remove a wrinkle. In this method, a roller positioned at the center is aligned in the transport direction and rollers positioned at left and right sides are aligned outwardly to apply an outward force to the sheets, thereby preventing wrinkle.

In the conventional method disclosed in Japanese Patent Publication (Kokai) No. 08-225221, the rollers have various outer diameters or separate rotating shafts offset in different directions, so that a plurality of the rollers is aligned in different directions. Accordingly, it is difficult to form the rollers, and the structure becomes complex.

In view of the problems described above, an object of the present invention is to provide a sheet transport apparatus in which a plurality of rollers arranged in a width direction has a transporting force in different directions with a simple structure, thereby preventing wrinkle or stain in sheets and unusual sounds.

Another object of the present invention is to provide an image reading apparatus in which wrinkle and unusual sounds are eliminated when sheets are registered.

Further objects and advantages of the invention will be apparent from the following description of the invention.

SUMMARY OF THE INVENTION

To attain the objects described above, according the present invention, a plurality of rollers has rotating shafts supporting the rollers in a sheet width direction and capable of elastically deforming in a bow shape in a transport direction. According to the present invention, a sheet transport apparatus includes a sheet transport path for transporting sheets; a drive roller arranged in the transport path and having a drive rotating shaft connected to drive means; a follower roller contacting the drive roller and having a follower rotating shaft. Each of the drive and follower rollers is formed of more than two rollers arranged perpendicular to the transport direction. The sheet transport apparatus further includes urging means disposed on the follower rotating shaft for pressing the follower rollers against the drive rollers in the transport direction.

According to the present invention, in the structure described above, the follower rotating shaft may be supported on a bearing to be movable in a direction toward the drive rotating shaft. The urging means may be formed of an urging spring for urging in a direction with a predetermined angle relative to a direction that the follower rotating shaft moves. Accordingly, the urging spring constituting the urging means presses the follower roller against the drive roller to apply a transport force to the sheets. At the same time, the urging spring deforms the follower rotating shaft, so that the follower roller is inclined in a direction not to cause wrinkle or stain in the sheets.

According to the present invention, in the structure described above, each of the drive roller and the follower roller may be formed of three or more rollers arranged in a direction perpendicular to the transport direction. The urging means is formed of the urging spring for applying an urging force to a roller positioned at a center of the follower rotating shaft greater than that that to a roller positioned at a left or right side. Accordingly, it is possible to apply a large bending force to the roller positioned at the center of the follower rotating shaft. Further, the roller at the left or right side is not shifted, so that the follower rotating shaft deforms uniformly.

According to the present invention, in the structure described above, each of the drive and follower rollers may be formed of a roller positioned at a center of the drive rotating shaft or the follower rotating shaft and two or more rollers positioned at left and right sides thereof. The urging means may be formed of at least two urging springs disposed adjacent to left and right sides of the roller positioned at the center.

According to the present invention, in the structure described above, the transport path sets the sheets according to a center reference in which a center in a direction perpendicular to the transport direction is a reference. The drive and follower rollers positioned at the center are arranged at positions corresponding to the center reference of the sheets. Accordingly, the rollers at the left and right sides apply the transport force to the sheets in an outward direction, thereby preventing wrinkle or noise.

According to the present invention, in the structure described above, the rollers constituting the drive roller may have an outer diameter larger than those of the rollers constituting the follower roller. Accordingly, when the follower rotating shaft is deformed in a bow shape, the follower roller is deformed along an outer surface of the drive roller, thereby reducing a force 'such as a twisting force applied to the follower roller.

According to the present invention, in the structure described above, the rollers constituting the follower roller may be formed of a material less elastically deformable than that of the rollers constituting the drive roller. When the follower rotating shaft bends, contacting surfaces of the rollers twist. The rollers of the drive roller are elastically deformed to absorb the twisting. The rollers of the follower roller apply the transport force to the sheets according to the deformation of the follower rotating shaft.

According to the present invention, a sheet transport apparatus includes a sheet transport path for transporting sheets; a drive roller disposed in the transport path and having a drive rotating shaft connected to drive means; a follower roller contacting the drive roller and having a follower rotating shaft. Each of the drive and follower rollers is formed of three or more rollers spaced in a direction perpendicular to a transport direction. The sheet transport apparatus further includes bearings disposed at left and right sides at an equal distance away from the roller positioned at a center of the follower rotating shaft for supporting both ends of the follower rotating shaft to be movable toward the follower rotating shaft. The sheet transport apparatus further includes urging means for urging the follower rotating shaft in a direction different from a direction that the follower rotating shaft moves. Accordingly, it is possible to deform the follower rotating shaft in a bow shape at the center of the bearings at the left and right sides.

According to the present invention, in the structure described above, the urging means is arranged in a direction such that a partial force in the transport direction is applied to the follower rotating shaft, thereby bending the follower rotating shaft in the transport direction.

According to the present invention, a sheet transport apparatus includes a sheet stacker for storing sheets; separating means for separating the sheets stacked on the sheet stacker; a pair of register rollers for temporarily stopping the sheets from the separating means and transporting the sheets further toward a downstream side; and sheet feeding means for feeding the sheets from a pair of the register rollers to a sheet processing platen. The pair of the register rollers is formed of at least two rollers mounted on a drive rotating shaft and a follower rotating shaft. The sheet transport apparatus further includes urging means disposed on the follower rotating shaft for urging the rollers on the follower rotating shaft against the rollers on the drive rotating shaft in the transport direction. Accordingly, the pair of the register rollers can transport the sheets separated at a downstream side of the separating means without causing wrinkle or stain in the sheets.

According to the present invention, an image reading apparatus includes a transport path for guiding sheets from a sheet stacker to a discharge stacker arranged vertically; a processing platen arranged in the transport path and having photoelectric conversion means for reading images on the sheets; separating means for separating the sheets on the sheet stacker; register means for temporarily stopping the sheets from the separating means and transporting the sheets further toward a downstream side; sheet feeding means for feeding the sheets from the register means to the processing platen; and discharging means for transporting the sheets from the processing platen toward a downstream side. The register means is formed of at least two rollers mounted on each of a drive rotating shaft and a follower rotating shaft. The sheet transport apparatus further includes urging means disposed on the follower rotating shaft for urging the rollers on the follower rotating shaft against the rollers on the drive rotating shaft in the transport direction. Accordingly, it is possible to transport the sheets to the processing platen without lowering reading performance caused by wrinkle or stain.

DETAILED DESCRIPTION OF PREFERRED EMBODIMENTS

Hereunder, preferred embodiments of the present invention will be described in detail with reference to the accompanying drawings.

Figure 1:
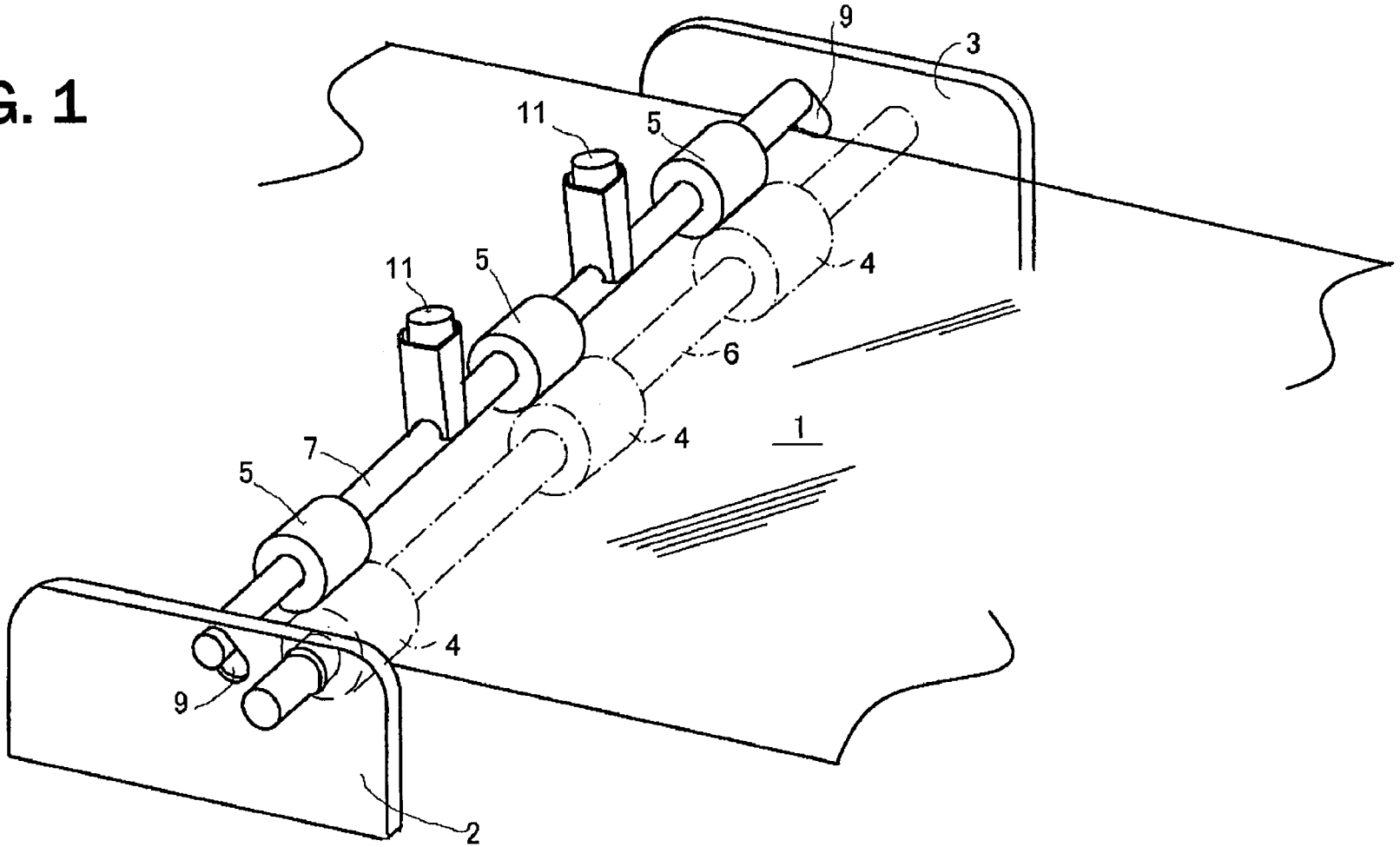
FIG. 1 is a perspective view showing an essential portion of a sheet transport apparatus according to an embodiment of the present invention.
Figure 2:
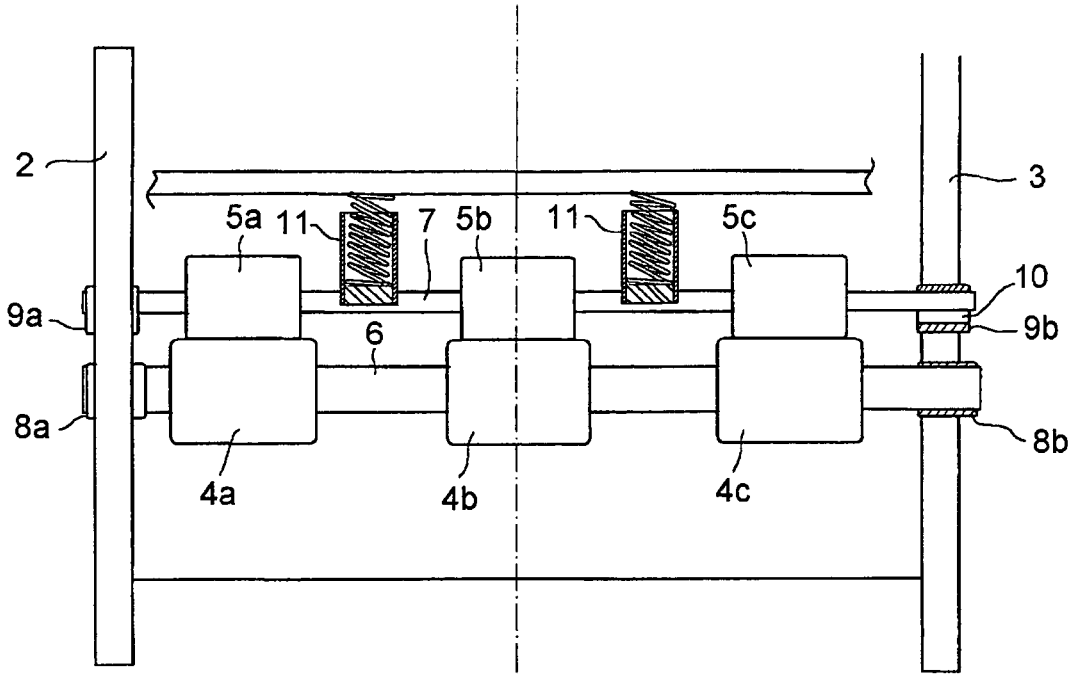
FIG. 2 is a vertical sectional view of the sheet transport apparatus shown in FIG. 1.
Figure 3A:
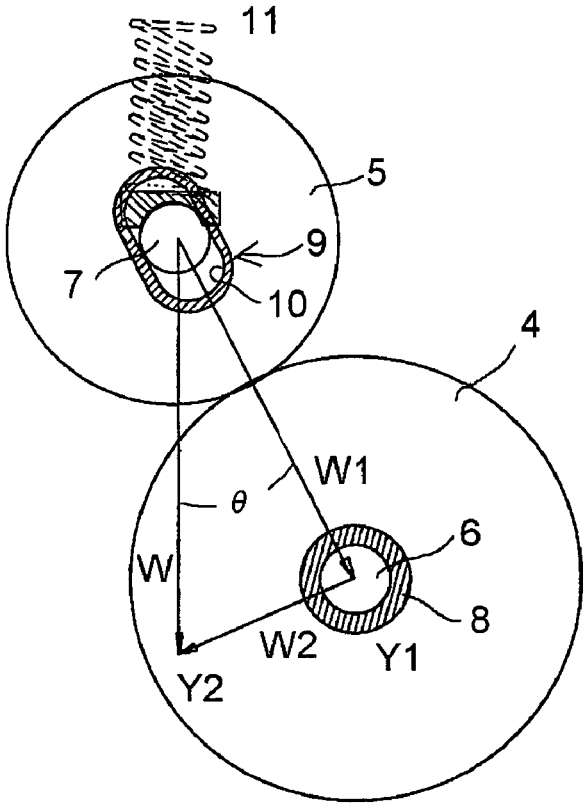
FIG. 3(*a*) is a view for explaining an operation of the sheet transport apparatus, and FIG. 3(*b*) is a view showing a structure of urging means.
Figure 3B:
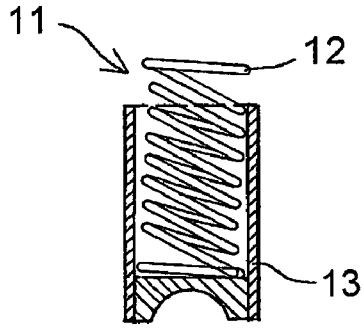

FIG. 1 and FIG. 2 are views showing a sheet transport apparatus according to an embodiment of the present invention. FIGS. 3(*a*), 3(*b*) and 4 show an action of the sheet transport apparatus. In FIG. 1, reference numeral 1 is a guide member constituting sheet transport path, and formed of a pair of plate-shaped members arranged to face each other and form a gap for passing sheets.

A pair of rollers 4 and 5 is arranged to nip the sheets on the guide member via the guide member 1. One of the rollers is a drive roller 4 and the other is a follower roller 5. The drive rollers 4 are mounted to a drive rotating shaft 6 connected to a drive motor (described later) via a transmission mechanism. The follower rollers 5 are mounted to a follower rotating shaft 7 pressed against the drive rollers 4. The follower rollers 5 are configured to rotate along with the sheets, and the drive rollers 4 move the sheets. The drive rollers 4 and follower rollers 5 are formed of a plurality of rollers 4*a*, 4*b*, 4*c*, 5*a*, 5*b* and 5*c* on the drive rotating shaft 6 and the follower rotating shaft 7 arranged in parallel to each other in a direction perpendicular to a sheet transport direction. The drive rotating shaft 6 and the follower rotating shaft 7 are rotatably supported on bearing members in apparatus frames 2 and 3.

The structure described above is a general structure, and a structure according to the present invention will be described in detail below. The drive rotating shaft 6 is rotatably mounted on the bearing members 8*a* and 8*b* in the apparatus frames 2 and 3. The follower rotating shaft 7 is arranged in parallel to the drive rotating shaft 6, and has both ends movably supported on the bearing members 9*a* and 9*b* in a direction of the drive rotating shaft 6. The bearing groove 10 is formed in the bearings 9*a* and 9*b* for engaging and supporting the follower rotating shaft 7 to move for a predetermined amount in the drive rotating shaft direction. The rollers 4*a*, 4*b*, 4*c*, 5*a*, 5*b*, and 5*c* contacting each other are fastened to the drive rotating shaft 6 and follower rotating shaft 7.

Urging means such as a spring is disposed on the follower rotating shaft 7 for pressing the follower rollers 5 toward the drive rollers 4. The urging means 11 may be arranged to act on only a part of the follower rotating shaft 7. It is preferred that the urging means 11 is arranged at two or more locations to apply a balanced force to the follower rotating shaft 7. As shown in FIG. 3(*b*), the urging means 11 has a holder 13 made of a plastic such as polyacetal at one end of a coil spring 12, and the holder 13 engages the follower rotating shaft 7. The plastic holder 13 is disposed between the shaft 7 and the coil spring 12, thereby obtaining smooth movement and reducing friction.

Figure 4:
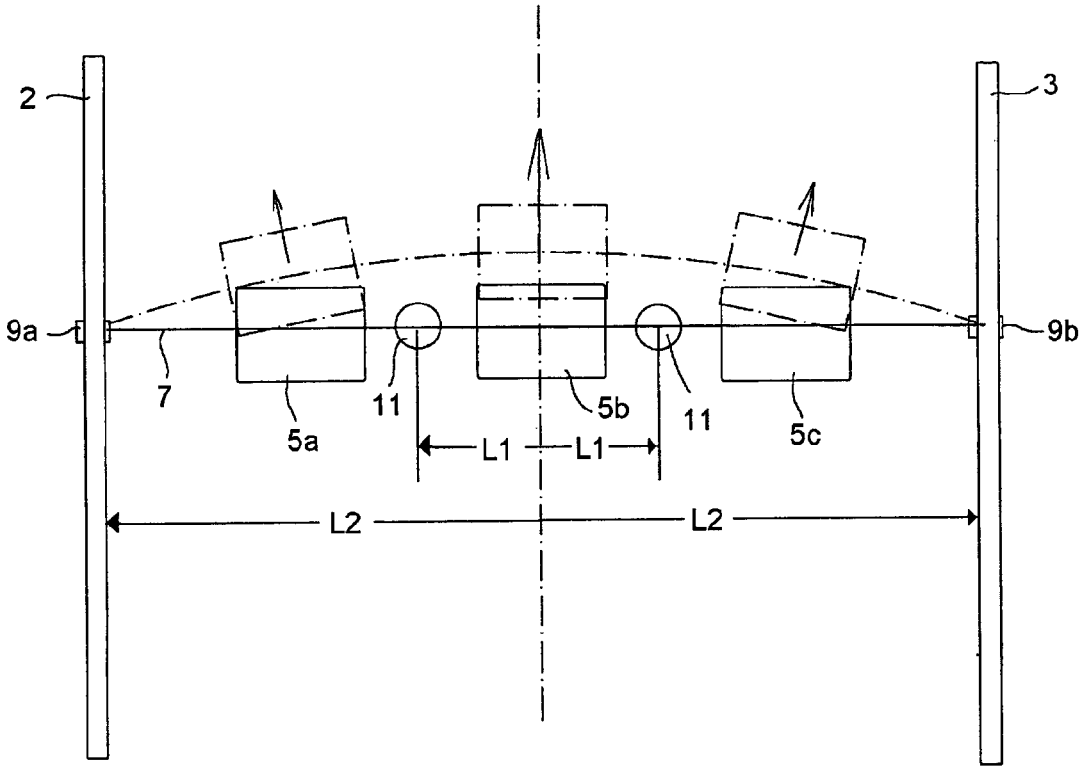
FIG. 4 is a view for explaining an operation of a follower roller.

The urging means 11 applies an urging force to the follower rotating shaft 7 in a direction Y2 inclined by a predetermined angle θ (5 to 10 degrees as described below) relative to the drive rotating shaft direction Y1 shown in FIG. 3(*a*). Therefore, the urging means 11 applies a force to the follower rotating shaft 7 in the drive rotating shaft direction and a direction perpendicular thereto. As shown in FIG. 4, the force is applied to a central portion of the follower rotating shaft 7 in the transport direction different from the direction of the drive rotating shaft 6, so that the follower rotating shaft 7 elastically deforms. When the follower rotating shaft 7 deforms, the follower rollers 5 apply a transport force to the sheet outwardly, and an optimum condition will be described below.

It is arranged such that the urging means 11 deforms the drive rotating shaft 6 as less as possible. Accordingly, it is possible to reduce vibration generated by the rotation when the drive rotating shaft 6 deforms. In the embodiment, the drive and follower shafts are made of SUM material, and the drive rotating shaft has a diameter of 8 mm, and the follower rotating shaft has a diameter of 4 mm. When the urging force of the urging means 11 is 3.6 kg, the drive rotating shaft 6 does not deform and shake. On the other hand, the follower rotating shaft 7 deforms by a predetermined bending amount as described below. In this way, the drive rotating shaft 6 is formed of the material and has the diameter so that the rollers mounted thereto do not shake by rotation. The follower rotating shaft 7 is formed of the material and has the diameter so that the urging means 11 can easily deform the follower rotating shaft 7.

The drive rollers and follower rollers are arranged such that the follower rollers are inclined in a direction to transport the sheets. When the sheets are transported with a center reference as shown in the drawing, the rollers are arranged symmetrically at left and right sides relative to the center of the follower rotating shaft. Particularly, not shown in the drawings, the rollers 4*a*, 4*c*, 5*a* and 5*c* are disposed symmetrically at the left and right sides relative to the rollers 4*b* and 5*b* positioned at the reference position for the sheet transport. When the sheets are intentionally transported in an oblique direction, a side guide may be disposed to align side edges of the sheets along the guide member, and the rollers are arranged on one side, not symmetrically.

The drive and follower rollers may be formed of a same material. It is preferred that one of the rollers is capable of elastic deformation. When the shaft deforms, the rollers contact at a various position. When one of the rollers is capable of absorbing the variation, it is possible to transport the sheets in a stable manner. In the drawing, the drive rollers 4 are formed of a soft material such as EPDM (ethylene propylene rubber), and the follower rollers 5 are formed of a hard material such as POM (polyacetal resin). The drive rollers have a larger outer diameter, so that the transport force is applied to the sheets along the direction of the follower rollers.

The urging means 11 applies the force to the follower rotating shaft in the drive shaft direction and the transport direction perpendicular to the drive shaft direction. The urging means 11 may be formed of individual springs, or one spring 12 arranged in an inclined state as shown in the drawings for applying the force in the both directions. As shown in FIG. 3(*a*), when the urging means 11 applies the force in the direction inclined by a predetermined angle θ, a force W of the urging means is separated into a force W1 toward the drive shaft and a force W2 perpendicular to W1. W1 is supported as a reactive force on the drive shaft, and W2 (sin θ) acts on the follower rotating shaft as a bending force. Accordingly, when the sheets are transported with the center reference, the bearing members 9*a* and 9*b* of the follower rotating shaft 7 are disposed at the left and right sides at an equal distance away from the reference, and the urging means 11 are also disposed at left and right sides at an equal distance.

In the embodiment, the rotating bodies 4*b* and 5*b* are disposed at the center reference position, and the urging means 11 formed of two springs are disposed at left and right sides thereof. The rollers positioned at the center receive the urging force twice large as that of the rotating bodies 4*a*, 4*c*, 5*a* and 5*c* positioned at left and right sides thereof, so that the follower rotating shaft 7 receives a doubled bending force. Accordingly, even when the rollers at the left and right sides are slightly offset, the deformation of the follower rotating shaft 7 is not affected much. According to an experiment in the structure, when each of the urging means 11 has a spring force of 1.8 kg, i.e. a total of 3.6 kg, and is inclined by θ of 5 to 10 degrees, it was found that the sheets were transported smoothly.

The following shall describe an embodiment of the present invention applied to an image reading apparatus. The image reading apparatus shown in FIG. 6 includes an image reading unit 100 and a sheet supply unit 200. Each unit is disposed in independent casings 101 and 201. The image reading unit 100 comprises platens 102 and 103 disposed in the casing 101 for placing sheets (originals); a data reading unit (image reading means) 104 for optically reading the sheets on the platens; a data processing unit 105 for processing image signals from the reading unit; and a data output unit 106 for transferring data to a copier or other apparatus.

The platens 102 and 103 are clear glass plates mounted on the top of the casing 101. The first platen 102 is formed of a glass plate large enough for placing the maximum size sheet, and the second platen 103 is formed of a glass plate having a length (left to right direction in FIG. 6) large enough for sequentially reading each line of the sheets and a width (depth direction in FIG. 6) large enough for the maximum size sheet. The second platen 103 is provided for reading the sheets sequentially fed by the sheet supply unit 200. When it is difficult to feed sheets such as books or large-sized originals, they can be placed on the first platen 102 to be read. In this structure, it is acceptable to omit the first platen 102, or to form the first and second platens with a single glass plate, not the two glass plates.

The reading unit (image reading means) 104 comprises a light source 107 for irradiating light onto the sheet on the platen 102 or 103; an image forming lens 108 for collecting light reflected from the sheet; and photoelectric conversion elements 109 for converting light from the image forming lens 108 into an electrical signal. The photoelectric conversion elements include a CCD device for accumulating electrical charges generated by light from the image forming lens 108 and outputting an electrical signal to an external unit, and a contact type device formed of the light source and image forming lens integrated with a light sensitive layer.

The reading unit 104 shown in the drawing has the photoelectric conversion elements 109 on a carriage 111 movable along the first platen 102. Specifically, line sensors (CCD devices) for reading each line (in line order) of the sheets are used as the photoelectric conversion elements 109. The light source 107, the image forming lens 108, the photoelectric conversion elements 109, and the mirror 110 for guiding light reflected from the original are combined in a plastic block to form the carriage 111. The carriage 111 reciprocally moves along a guide rail (not shown) to the left and right directions in FIG. 6 with a timing belt 112 and a carriage drive motor 113. The carriage 111 moves in the left and right directions in FIG. 6 along the first platen 102 and is stopped (still) at the reading position on the second platen 103 for reading the sheet moving sequentially over the second platen 103.

The reading unit 104 sends the image data, and the data processing unit 105 converts the data into digital information. After data correction such as dither and gamma corrections, the data is transferred externally from the image transfer unit 106. The image transfer unit 106 electrically sends the image information of the original sheet to a computer, facsimile machine, copier, or network server.

The sheet supply unit 200 is mounted to the image reading unit as an attachment. The sheet supply unit 200 is provided with a sheet stacker 202 and discharge stacker 203 vertically arranged on a casing 201. As shown in the drawing, the sheet stacker 202 is arranged at an upper side, and the discharge stacker 203 is arranged at a lower side. The sheet stacker may be arranged at the lower side and the discharge stacker may be arranged at the upper side. The sheet supply unit 200 is mounted to the image reading unit 100 so that the sheet stacker 202 and the discharge stacker 203 are positioned above the first platen 102. The sheet supply unit 200 is hinged at a backside in FIG. 6 so that the first and second platens are opened.

The sheet stacker 202 is composed of a tray for storing the sheets. A pickup roller 204 is disposed on a leading edge of the sheet stacker 202 for picking up the sheets one at a time. A reference is disposed on the sheet stacker 202 according to whether the sheets having differing sizes are placed with a center reference or a side reference. The embodiment shown in the drawing is the center reference in which a pair of side guide plates 205 is mounted on the tray movably in the sheet width direction (perpendicular to a transport direction) for guiding both sides of the sheets. The side guide plates 205 at left and right sides are arranged such that the side guide plates 205 separate and approach by a constant amount through an connecting mechanism 206 disposed on a backside of the tray. The connecting mechanism 206 includes several known mechanisms, and a description thereof is omitted.

Figure 6:
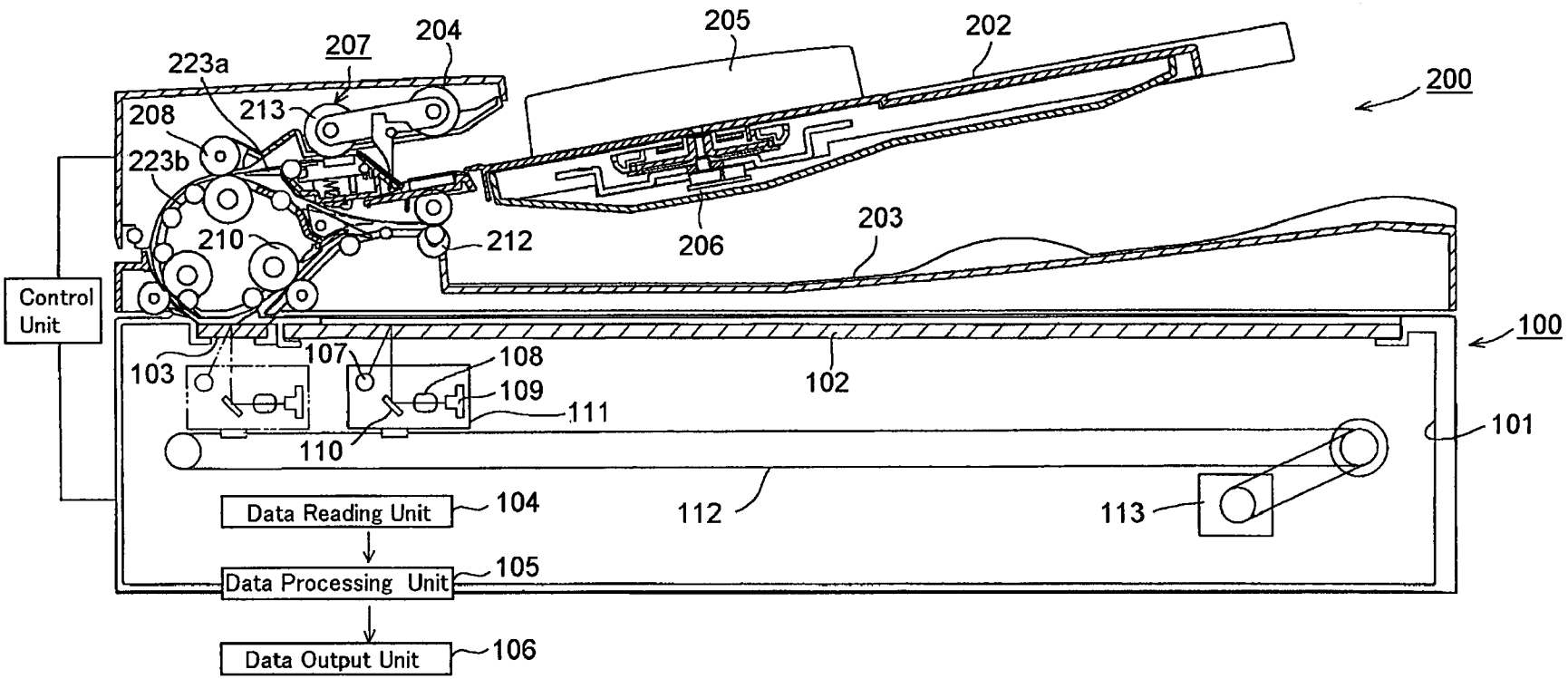
FIG. 6 is a view showing the image reading apparatus provided with the sheet transport apparatus shown in FIG. 1.

As shown in FIG. 6, the sheet stacker 202 and the discharge stacker 203 are connected to a sheet transport path having a substantially U-shape, and the sheet processing platen is arranged in the sheet transport path. In the sheet transport path, there are arranged the discharge stacker 202, sequential separating means 207; register means 208; sheet feeding means 209; the processing platen (second platen 103); sheet transport out means 210; and discharging means 212 in this order.

The separating means 207 includes a separation roller 213 and a friction pad 214 contacting the separation roller 213, and is disposed at the leading end of the sheet stacker 202 for separating the sheets stacked on the sheet stacker 202 into a single sheet. The register means 208 is arranged at a downstream side of the separating means 207, and comprises pairs of rollers 220 and 221 contacting each other, i.e. drive rollers 220 and follower rollers 221. The sheet feeding means 209 is arranged at a downstream side of the register means 208, and comprises feed drive rollers 225 and feed follower rollers 226 contacting each other. The sheet transport out means 211 comprises transport out drive rollers 230 and transport out follower rollers 231. The discharge means 212 comprises discharge drive rollers 241 and discharge follower rollers 242 contacting each other.

The sheet separating means 207 comprises the separation roller 213 for feeding the sheets in the feeding direction and the separation pad 214 contacting the separation roller. The separation roller 213 is formed of a rubber roller mounted on a rotating shaft 215 connected to a drive motor (described below), and is positioned at a center of the sheets on the sheet stacker 202 as one roller (rotating body). A bracket 216 extending to the sheet stacker 202 is disposed on the rotating shaft 215. A pick-up roller 204 is mounted at a leading end of the bracket 216.

Figure 7:
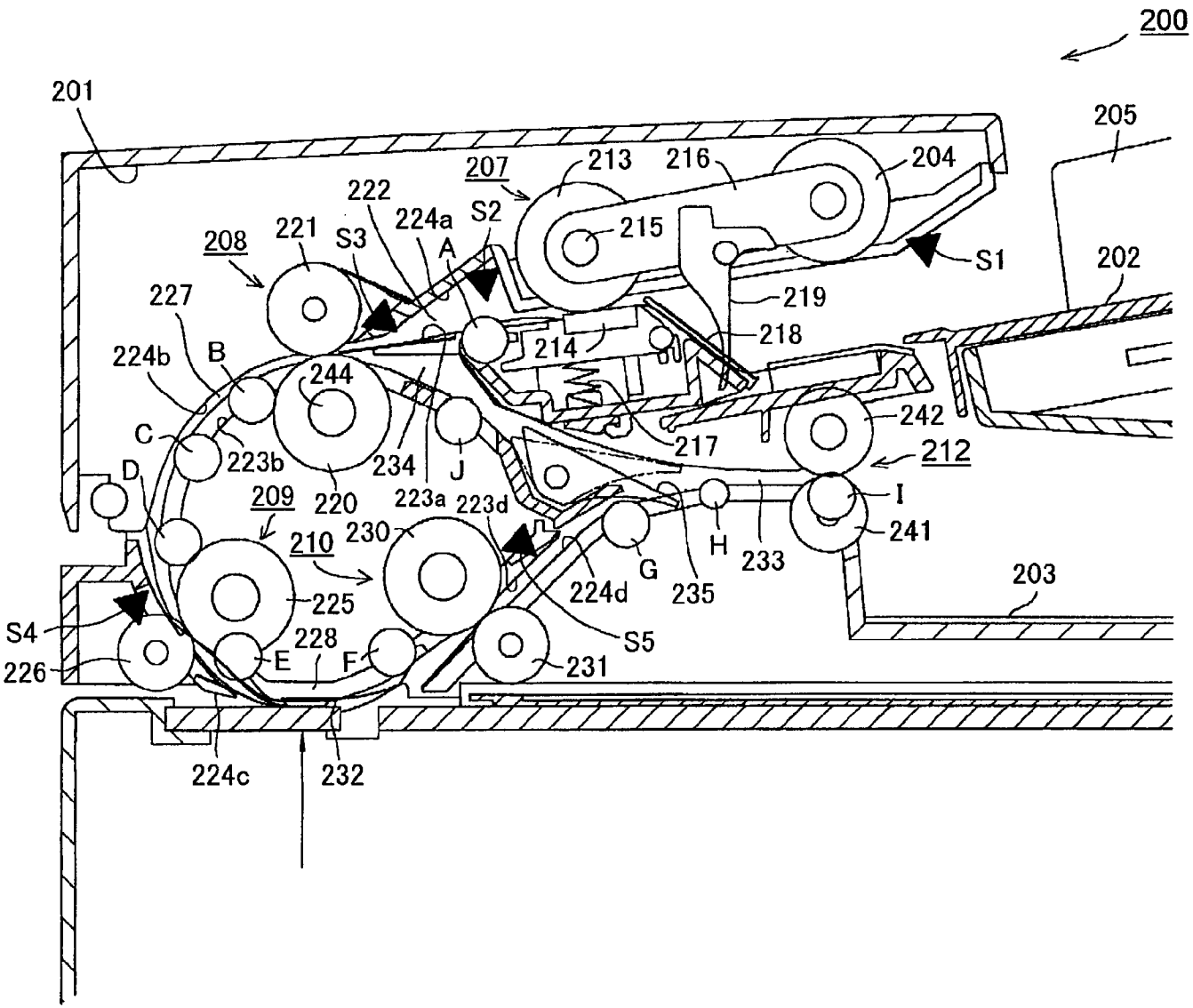
FIG. 7 is an enlarged view showing a portion of the image reading apparatus shown in FIG. 6.

The separation roller 213 is attached to the rotating shaft 215 via a spring clutch, so that a rotation of the rotating shaft 215 in one direction is transmitted to the roller 213 and a rotation of the rotating shaft 215 in the other direction (counterclockwise direction in FIG. 7) is not transmitted to the roller 213. A spring clutch is also disposed between the rotating shaft 215 and the bracket 216. Accordingly, when the rotating shaft 215 rotates in the counterclockwise direction in FIG. 7, the bracket 216 swings upwardly above the sheet stacker 202. When the rotating shaft 215 rotates in the clockwise direction in FIG. 7, the clutch is released to allow the bracket 216 and the pickup roller 204 mounted thereto to fall under their own weight.

The rotation of the rotating shaft 215 only in the clockwise direction is transmitted to the pickup roller 204 with a transmission belt through the one-way clutch. Therefore, when the rotating shaft 215 is rotated in the clockwise direction in FIG. 7, the separation roller 213 and the pickup roller 204 rotate in a direction to draw the sheet, and the pickup roller 204 and bracket 216 fall toward the sheet stacker 202. Conversely, when the rotating shaft 215 rotates in the counterclockwise direction, the roller 213 and roller 204 are still while the bracket 216 is moved to a retracted position above the sheet stacker 202.

A friction pad 214 formed of a resilient material is pressed against the separation roller 213 by an urging spring 217. A separating member 218 is disposed at the leading end of the sheet stacker 202. Accordingly, the sheets stacked on the sheet stacker 202 are sequentially picked out by the pickup roller 204. Then, the sheets are separated in a wedge-shape at the separating member 218 and fed between the separation roller 213 and the friction pad 214. The friction pad 214 and separation roller 213 have a predetermined friction coefficient relative to a friction coefficient of the sheets so that the separation roller feeds a single sheet.

A gate stopper 219 is rotatably mounted to the bracket 216, and is located at a position shown in the drawing when the pickup roller 204 is positioned at a retracted position above the sheet stacker 202. When the pickup roller 204 swings downwardly toward the stacker 202, the gate stopper 219 swings in the clockwise direction in FIG. 7 to form a sheet advancing path. The gate stopper 219 prevents the sheets from being fed too far when the sheets are placed on the stacker. In the embodiment, the separating means 207 is formed of the separation roller and friction pad, and may be formed of an endless belt instead of the separation roller and a retard roller rotating in a direction opposite to the separation roller instead of the friction pad.

Figure 5:
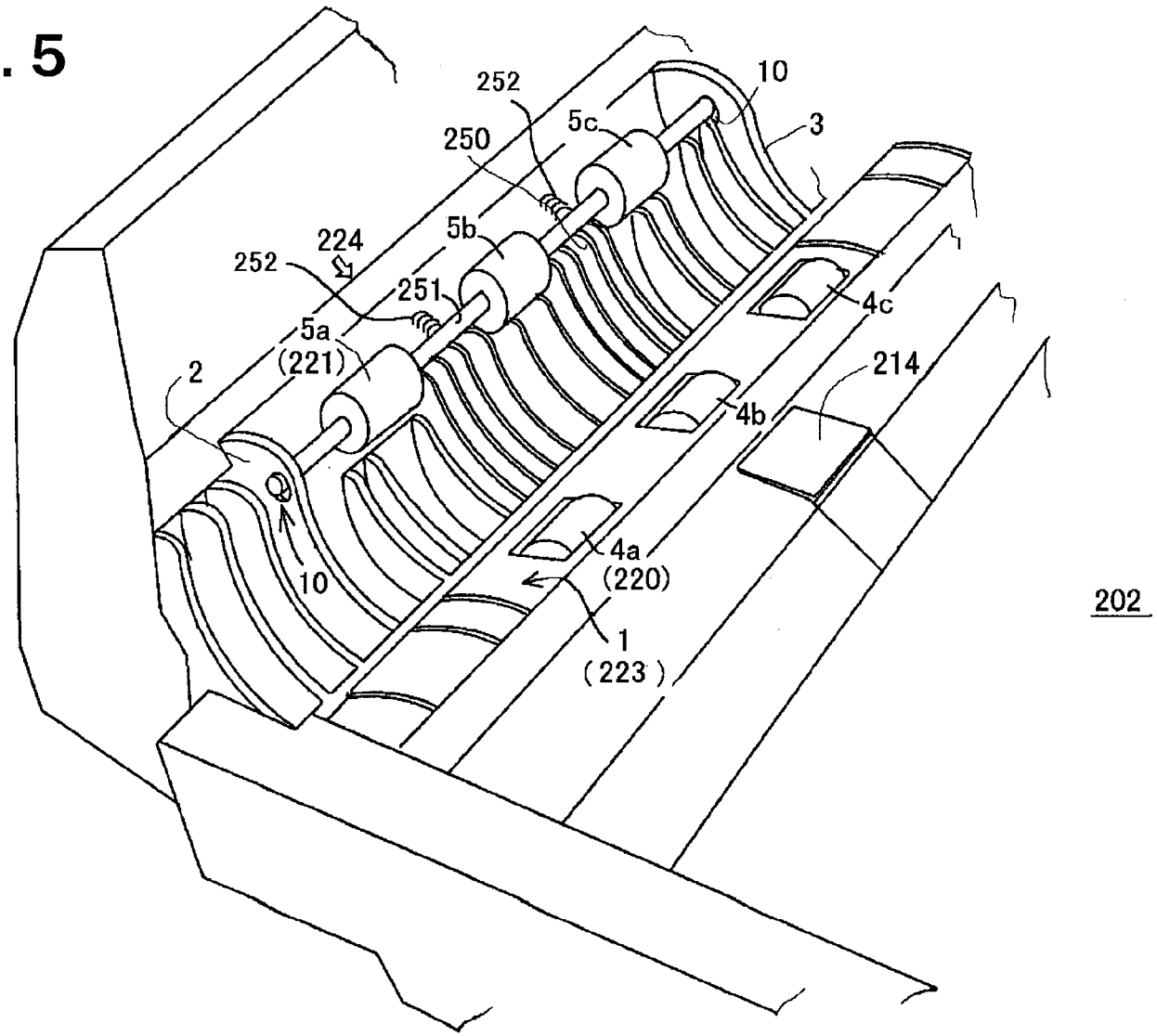
FIG. 5 is a perspective view showing an essential portion of an image reading apparatus provided with the sheet transport apparatus shown in FIG. 1.
Figure 9:
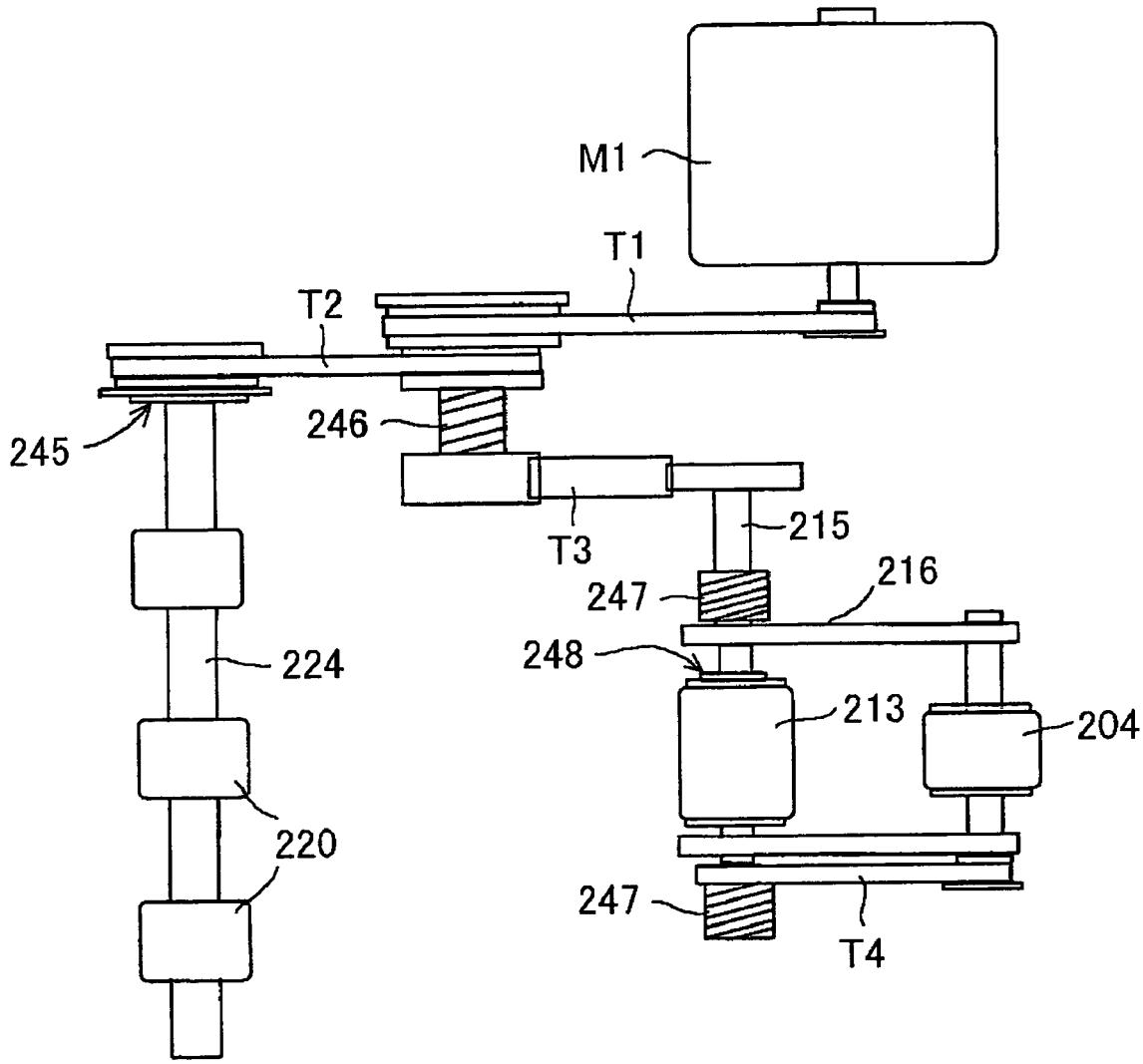
FIG. 9 is a view showing a drive mechanism of the image reading apparatus shown in FIG. 6.
Figure 10:
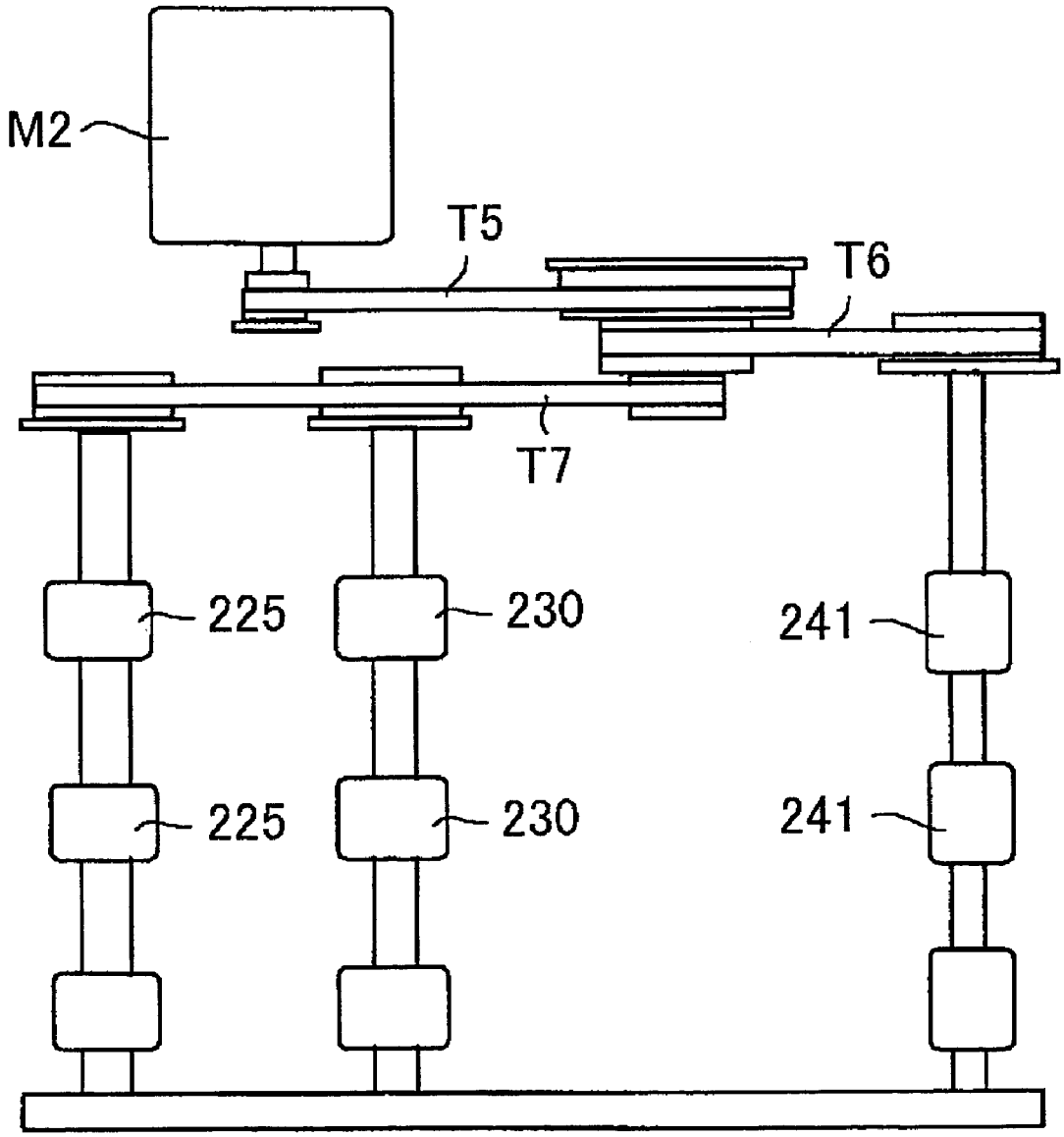
FIG. 10 is a view showing a drive mechanism of the image reading apparatus shown in FIG. 6.

The pairs of register rollers 208 formed of the drive rollers 220 and the follower rollers 220 are arranged at a downstream side of the separating means 207, and function as the transport mechanism described above. The sheets fed by the separation roller 213 are led to the sheet feed path 222. The drive rollers 220 and follower rollers 221 are mounted to a pair of transport guides 223 and 224 constituting the sheet transport path as shown in FIG. 5. A drive rotating shaft of the drive rollers 220 is rotatably mounted to the apparatus frame in the first transport guide 223. The follower rollers 221 are arranged in the second transport guide 224, and a drive rotation shaft thereof is rotatably supported on a side frame of the sheet supply unit (not shown). As shown in FIG. 9 and FIG. 10, a drive motor is connected to the drive rotation shaft. A plurality of ribs 250 are integrated with a casing 201 of the second transport guide 224 provided with the follower rollers 221 for guiding the sheets. The follower rotating shaft 251 is mounted to the ribs 250 as shown in FIG. 5. The urging spring 252 is placed between the follower rotating shaft 251 and the casing 201.

The feed rollers 209 are disposed at a downstream side of the register means 208, and are formed of the feed drive rollers 225 and feed follower rollers 226 contacting each other. The feed rollers 209 are disposed adjacent to the processing platen at a downstream side for accurately feeding the sheet to the processing platen when a timing sensor S4 (described below) detects a leading edge of the sheet. The sheet transport path 227 formed of a guide 223*b* and a guide 224*b* is disposed between the register means 208 and feed rollers 209. The processing platen (second platen 103) is disposed at a downstream side of the feed rollers 209. The backup plate 228 is mounted to the first transport guide 223 to form a small gap along with the second platen 103. The sheet transport out means 210 formed of the transport out drive rollers 230 and the transport out follower rollers 231 is arranged at a downstream side of the processing platen 103.

The feed rollers 209 and the pairs of the sheet transport out rollers 230 and 231 are arranged adjacent to the processing platen 103 for feeding the sheets to the processing platen 103 and transporting the sheets from the processing platen. The sheet processing path 232 is formed of a guide 223C, guide 224C, the second platen 103 and the backup plate 228, and is arranged between the pairs of the sheet transport rollers 225 and 226 and pairs of the sheet transport out rollers 230 and 231.

The pairs of discharge rollers 241 and 242 are arranged at downstream side of the pairs of sheet transport out rollers 230 and 231. The discharge path 233 is formed of a guide 223*d* and a guide 224*d*, and is arranged between the sheet transport out rollers 230 and 231 and the discharge rollers 241 and 242. The discharge stacker 203 is arranged immediately behind the discharge roller 213. The sheets are sent from the sheet stacker 202 to the discharge stacker 203 via the feed path 222, the sheet transport path 227, the processing path 232 and the discharge path 233. These paths are formed in the U-shaped transport path.

Free-moving rollers A are arranged in the feed path 222; free-moving rollers B, C and D are arranged in the sheet transport path 227; free-moving rollers E and F are arranged in the processing path 232; and free-moving rollers G, H and I are arranged in the discharge path 233. The free-moving rollers A contacting and moving with the sheets are disposed in the transport guide 223*a* of the transfer guide 223 at an inner side of the U-shape of the feed path 222. The free-moving rollers A protrude into the path from the guide 223*a*, and are arranged in plurality in the sheet width direction. As shown in the drawing, the free-moving rollers A include one roller at the center and two rollers symmetrically placed at left and right sides thereof for transporting the sheets with the center reference. The separation roller 213 constituting the separating means 207 is controlled to stop after separating and feeding the sheet to the pairs of the register rollers 220 and 221, so that a second sheet is not fed. It is preferred that the free-moving rollers A are arranged at positions to reduce load when the sheet is drawn from the separation roller 213 with the register rollers and feed rollers at the downstream side.

Figure 8:
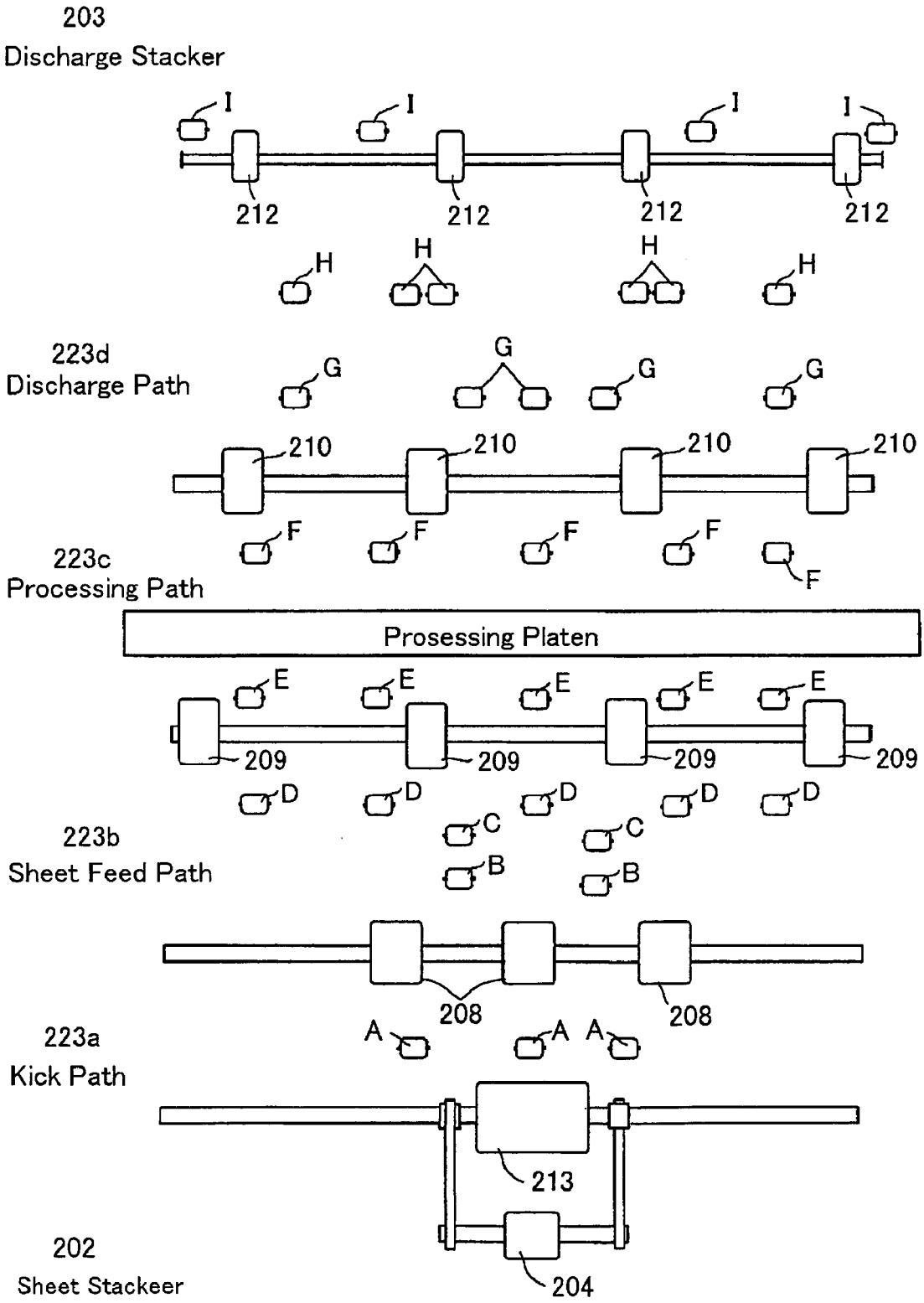
FIG. 8 is an exploded plan view showing a sheet transport path of the image reading apparatus shown in FIG. 6.

As shown in FIG. 8, the pickup roller 204, the separation roller 213, the free-moving rollers A, and the pairs of the register rollers 220 and 221 at the downstream side are arranged to form a triangle. Specifically, the separation roller 213 contacts the sheets at a central position in the sheet width direction, and the free-moving rollers A contact-the sheets at three locations at outer edges in the sheet width direction. The register rollers 220 and 221 are arranged to contact the sheets at three locations at further outer edges. Accordingly, it is possible to smoothly transport the sheets without making wrinkle. The transport guide 224*a* and the transport guide 223*a* provided with the free-moving rollers A are arranged to form a space for bending the sheets in a loop-shape.

A sheet drive mechanism from the sheet stacker 203 to the discharge stacker will be explained next with reference to FIG. 9 and FIG. 10. Along the path from the sheet stacker to the discharge stacker, there are arranged the pickup roller 204; the separation roller 213; the register rollers 220; the feed drive rollers 225; the transport out drive rollers 230; and the discharge drive rollers 241 in this order. In the embodiment, two drive motors M1 and M2 capable of rotating forward and reverse are connected to the rollers, and separate drive motors may control the rollers.

As shown in FIG. 9, the first drive motor M1 is connected to the separation roller 213 and the pickup roller connected thereto, and drives the same with the forward rotation. The first drive motor M1 is connected to the register rollers 220 and drives the same with the reverse rotation. The first drive motor M1 controls the pickup roller 204 to rise and fall with the forward and reverse rotations. The first drive motor M1 is connected to the rotating shaft 244 of the register rollers 220 via transmission belts T1 and T2. A one-way clutch 245 transmits the rotation of the motor M1 in one direction to the register rollers 220. A gear T3 transmits a drive force of the first drive motor M1 to the rotating shaft 215 of the separation roller 213 via a spring clutch 246. The one-way clutch 245 and spring clutch 246 transmit the forward drive of the first drive motor M1 to the separation roller, and the reverse drive to the register rollers.

The rotating shaft 215 of the separation roller 213 is supported on a bracket 216 via the spring clutch 247. The rotation of the rotating shaft 215 is transmitted to the pickup roller 204 mounted to the bracket 216 by a transmission belt T4.

When the first drive motor M1 rotates forward (counterclockwise direction in FIG. 6), the spring clutch 246 contracts and transmits the rotation to the gear T3 to rotate the rotating shaft 215 in the counterclockwise direction and rotate the separation roller and the pickup roller. At the same time, the spring clutch 247 relaxes to release the bracket 216, and the pickup roller falls toward the sheet stacker from the state shown in FIG. 9. The one-way clutch 245 is arranged not to transmit the rotation of the motor to the register rollers 220. Accordingly, when the first drive motor M1 rotates forward, the pickup roller 204 initially lowers from the raised idling position to touch the sheets on the sheet stacker and the separation roller separates the sheets into a single sheets.

When the first drive motor M1 rotates in reverse (clockwise direction in FIG. 6), the contracted spring clutch 246 transmits the rotation to the rotating shaft 215, and the rollers 213 and 204 stay idle due to the one-way clutch 248 attached to the rotating shaft 213. The rotation of the rotating shaft 215 is transmitted to the bracket 216, and the bracket 216 and the pickup roller mounted to the bracket swing in the counterclockwise direction in FIG. 9 to return the idling position above the sheet stacker.

A stopper (not shown) is disposed at the idling position for stopping the rotation of the bracket 216 and the rotating shaft 215. Accordingly, the spring clutch is relaxed, and the rotation of the motor is not transmitted to the separation roller. At that time, the one-way clutch 245 transmits the rotation to the register rollers 220. It is possible to perform the operation described above by setting the transmission directions of the one-way clutch and the spring clutch.

As shown in FIG. 10, the second drive motor M2 is connected to the sheet drive rollers 225, the transport out drive rollers 230, and the discharge drive rollers 241 via transmission belts T5, T6 and T7. One-way clutches (not shown) are attached to the sheet drive roller 225 and the transport out drive roller 230 for constantly transmitting the forward and reverse rotations of the motor as one directional rotation. The discharge drive rollers 241 rotate forward or in reverse with the forward or reverse rotations of the motor. As described above, the register rollers 220, the sheet drive rollers 225, the transport out drive rollers 230, and the discharge drive rollers 241 arranged in the transport path have the follower rollers 221, 226, 231, and 242 arranged in the transport guide 224, respectively. The pairs of the transport rollers rotate at the same speed to apply a uniform transport force to the sheets.

It is difficult to form the drive rollers in same diameters, so that the drive rollers at a downstream side have diameters to obtain a higher circumferential speed within a tolerance range of manufacturing. Specifically, the drive rollers at a downstream side have diameters with positive tolerance in the dimensions relative to the drive rollers at an upstream side. Also, it is arranged that the follower rollers at a downstream side have a greater contact pressure.

Sensors are arranged in the transport path for detecting the leading edge of the sheet. A plurality of size sensors (not shown) is arranged for detecting the size of the sheets stacked on the sheet stacker 202 and for controlling the subsequent sheets to be fed. A variety of structures and methods of control are well known, and a description is omitted. An empty sensor S1 is arranged at the leading end of the sheet stacker 202 for detecting the sheets thereon. When the empty sensor S1 detects the final sheet, the empty sensor S1 sends a signal to a processing unit such as the image reading unit 100. A separation sensor S2 is disposed at a downstream side of the separating means 207 for stopping the apparatus and generating a warning of a non-feed when the sheet is not detected for a predetermined period of time after the rotating start signal (sheet feed instruction signal) of the separation roller 213 is sent.

A register sensor S3 is disposed in front of the register means 208 for sending a motor stop signal to the first drive motor M1 control unit after enough time, so that a predetermined register loop is formed when the leading edge of the sheet is detected. A timing sensor S4 is disposed in front of the sheet feeding means 209 for sending a signal to the processing unit (image reading unit 100) when the leading edge of the sheet is detected, so that a starting line of a text or a starting location of an image is identified. When the sensor S4 does not detect the leading edge of the sheet for a predetermined period of time after the sheet feed signal of the register roller 220 is sent, the first drive motor M1 and the second drive motor M2 are stopped and a warning signal is output as a paper jam.

A discharge sensor S5 is disposed at a downstream side of the transport out drive rollers 230 for detecting the leading and trailing edge of the sheets to identify a paper jam. In a sheet recirculation mode, when the trailing edge of the sheet is detected, the discharge sensor S5 sends a signal, so that the second drive motor M2 rotates in reverse after a predetermined period of time after the trailing edge of the sheet is detected.

An operation of the apparatus described above will be explained next. The image reading apparatus shown in FIG. 5 has a single side reading mode in which one side of the sheet on the stacker is read sequentially, and a duplex reading mode in which after one side of the sheet is read, the sheet is switched back and the other side of the sheet is read. In the single side reading mode, a user directly inputs a mode setting command to the image reading unit 100, or a device such as a computer connected to the image reading unit 100 issues such a command. When the image reading unit 100 receives the command, the carriage of the reading unit 104 is initialized, and moves to the second platen 103 and stops.

A job operation preparation signal is sent to the sheet feeding unit 200 from the control unit on the image reading unit 100 after the initialization process is completed. The empty sensor S1 detects the sheets on the sheet stacker 202 and sends a signal to the image reading unit 100. When the sheets are placed on the stacker 202, the first drive motor M1 drives the pickup roller 204 and the separation roller 213 to feed the uppermost sheet to the register means 208. The first drive motor M1 stops after a predetermined period of time after the register sensor S2 sends the signal. In this state, the leading edge of the sheet abuts against the pair of the register rollers, and idles.

When a sheet feeding signal is issued from the image reading unit 100, the second drive motor M2 starts rotating to send the sheet to the sheet supply path 227 using the register rollers 220. When the timing sensor S4 of the sheet supply path 227 detects the leading end of the sheet, a signal is sent to the image reading unit 100 to calculate a position where the leading edge of the sheet reaches the processing platen (second platen 103). The sheet fed to the sheet supply path 227 is fed to the processing platen 103 by the sheet supply rollers 225 and 226.

At the processing platen, the signal from the timing sensor S4 is used to calculate the position of the sheet to read the images and apply a process such as printing. The sheet fed from the processing platen is fed to the discharge path 233 by the pairs of the transport out drive rollers 230 and 231. In the single side mode, the sheet is stored on the discharge stacker 203 by the pairs of the discharge rollers 241 and 242 in the discharge path 233. After the trailing edge of the sheet enters the sheet supply path 227 based on the sheet detection signal from the register sensor S3, the first drive motor M1 rotates in reverse for feeding the next sheet on the sheet stacker 202 to the pairs of the register rollers, and the next sheet stays idle for the next sheet feed signal. It is possible to employ the sheet feeding signal in a case that the sheets are automatically fed after a predetermined period of time from the previous sheet, or until the image reading unit 100 sends the sheet feeding signal.

In the duplex reading mode, the second drive motor M2 rotates in reverse based on a detection signal of the discharge sensor S5 of the discharge path 233 detecting the trailing edge of the sheet. The pairs of the discharge rollers 241 and 242 rotate in reverse, thereby switching back the sheet and sending it to the recirculation path 234 using the path switching gate 235. The sheet sent from the recirculation path is turned over from front to back and returned to the processing platen 103 by the pairs of the register rollers and pairs of the feed rollers. After a backside of the sheet is processed, the transport out drive rollers feed the sheet from the discharge path 233 to be stored on the discharge stacker 203.

According to the present invention, the sheet feeding apparatus and image reading apparatus having the sheet feeding apparatus have the structures described above. When the sheet is fed with the pairs of drive rollers and follower rollers contacting each other, the follower rotating shaft supporting the follower rollers is elastically deformed in the sheet transport direction. Accordingly, the transport force is applied to the sheets outwardly by the follower rollers mounted on the shaft, thereby eliminating wrinkle or stain. In a case that the follower rotating shaft rotates together with the follower rollers, bearings may be disposed between the shaft and follower rollers to rotate only the rollers, thereby obtaining the same effect.

The disclosure of Japanese Patent Application No. 2003-167739 has been incorporated in the application.

While the invention has been explained with reference to the specific embodiments of the invention, the explanation is illustrative and the invention is limited only by the appended claims.

What is claimed is:

1. A sheet transport apparatus for transporting a sheet, comprising:

a transport path for transporting the sheet, a drive roller unit disposed in the transport path and having a drive shaft and at least two drive rollers arranged on the drive shaft in a first direction perpendicular to a second direction that the sheet is transported, drive means connected to the drive shaft for driving the drive roller unit, a follower roller unit disposed in the first direction in the transport path and having a follower shaft, bearings for supporting the follower shaft to be movable toward the drive shaft, and at least two follower rollers contacting the at least two drive rollers, and urging means attached to the follower shaft for pressing the at least two follower rollers to the at least two drive rollers in a direction with a predetermined angle with respect to the drive shaft, said urging means including an urging spring acting on the follower shaft in a direction inclined by the predetermined angle relative to the drive shaft so that the at least two follower rollers are pressed onto the at least two drive rollers with a force directed to the at least two drive rollers along the bearings and another force perpendicular to said force.

2. A shaft transport apparatus according to claim 1, wherein said another force acts on the follower shaft to slightly bend the follower shaft.

3. A shaft transport apparatus according to claim 2, wherein upon actuation of the transport apparatus, said follower shaft bends to project outwardly in a center thereof so that the at least two follower rollers orient in different directions.

4. A sheet transport apparatus according to claim 1, wherein said drive roller unit includes at least three drive rollers spaced in the first direction, and said follower roller unit includes at least three follower rollers spaced in the first direction, said urging means pressing the follower shaft such that one of the follower rollers situated at a center receives a force greater than that applied to the other two of the follower rollers situated at two sides.

5. A sheet transport apparatus according to claim 1, wherein said drive roller unit includes at least one drive roller situated at a center of the drive shaft and at least two drive rollers situated at two sides of the drive shaft, and said follower roller unit includes at least one follower roller situated at a center of the follower shaft and at least two follower rollers situated at two sides of the follower shaft, said urging means including at least two urging springs situated on two sides of the follower roller situated at the center.

6. A sheet transport apparatus according to claim 4, wherein said transport path is arranged to transport the sheet with a center reference based on a center of the sheet in the first direction, said one of the follower rollers and said one of the drive rollers being situated on the center of the sheet.

7. A sheet transport apparatus according to claim 1, wherein said drive rollers have a diameter larger than that of the follower rollers.

8. A sheet transport apparatus according to claim 1, wherein said follower rollers are formed of a material having rigidity greater than that of the drive rollers.

9. A sheet transport apparatus for transporting a sheet, comprising:

a transport path for transporting the sheet, a drive roller unit disposed in the transport path and having a drive shaft and at least two drive rollers arranged on the drive shaft in a first direction perpendicular to a second direction that the sheet is transported, drive means connected to the drive shaft for driving the drive roller unit, a follower roller unit disposed in the first direction in the transport path and having a follower shaft and at least two follower rollers contacting the at least two drive rollers, and urging means attached to the follower shaft for pressing the at least two follower rollers to the at least two drive rollers in a direction with a predetermined angle with respect to the drive shaft, wherein said drive roller unit includes at least three drive rollers spaced in the first direction, and said follower roller unit includes at least three follower rollers spaced in the first direction and two bearing portions disposed at positions away from one of the follower rollers situated at a center of the follower shaft by a substantially equal distance for supporting two ends of the follower shaft so that the follower shaft moves toward the drive shaft, said urging means pressing the follower shaft in a direction different from a direction toward the drive shaft.

10. A sheet transport apparatus according to claim 9, wherein said urging means is disposed in a direction that the follower shaft receives a partial force in the second direction.

11. A sheet transport device for transporting a sheet, comprising:

a sheet stacker for storing the sheet, separating means for separating the sheet on the sheet stacker, said sheet transport apparatus according to claim 1, said at least two drive rollers and said at least two follower rollers constituting a pair of register rollers for temporarily holding the sheet transported from the separating means and transporting the sheet toward a downstream side, and sheet feeding means for feeding the sheet from the pair of the register rollers to a sheet processing platen.

12. An image reading apparatus for reading an image on a sheet, comprising:

a sheet stacker for storing the sheet, a discharge stacker arranged vertically relative to the sheet stacker for storing the sheet, a transport path disposed between the sheet stacker and the discharge stacker for guiding the sheet from the sheet stacker to the discharge stacker, a processing platen arranged in the transport path and having photoelectric conversion means for reading the image on the sheet, separating means for separating the sheet on the sheet stacker, register means for temporarily holding the sheet transported from the separating means and transporting the sheet toward a downstream side, said register means including at least two drive rollers mounted on a drive shaft, at least two follower rollers mounted on a follower shaft, and bearings for supporting the follower shaft to be movable toward the drive shaft, urging means attached to the follower shaft for pressing the at least two follower rollers to the at least two drive rollers in a direction with a predetermined angle with respect to the drive shaft, said urging means including an urging spring acting on the follower shaft in a direction inclined by the predetermined angle relative to the drive shaft so that the at least two follower rollers are pressed onto the at least two drive rollers with a force directed to the at least two drive rollers along the bearings and another force perpendicular to said force, sheet feeding means for feeding the sheet from the register means to the processing platen, sheet transport means for transporting the sheet from the processing platen toward a downstream side, and discharge means for discharging the sheet from the sheet transport means to the discharge stacker.

* * * * *